United States Patent [19]

Yamanouchi et al.

[11] 4,400,580

[45] Aug. 23, 1983

[54] PROCESS FOR PRODUCING CROSSLINKED POLYETHYLENE INSULATED CABLE

[75] Inventors: Shosuke Yamanouchi; Keiichi Kojima, both of Osaka, Japan

[73] Assignee: Sumitomo Electric Industries, Ltd., Osaka, Japan

[21] Appl. No.: 374,136

[22] Filed: May 3, 1982

Related U.S. Application Data

[63] Continuation of Ser. No. 99,810, Dec. 3, 1979, abandoned.

[30] Foreign Application Priority Data

Dec. 1, 1978 [JP] Japan ..... 53-149212

[51] Int. Cl.[3] ..... H01B 13/14; H01B 1/00; H01B 5/16

[52] U.S. Cl. ..... 174/102 SC; 174/120 SC; 428/368; 428/372; 428/383; 427/120; 427/393.5; 427/388.2; 264/174

[58] Field of Search ..... 174/110 V, 110 PM, 120 SC, 174/102 SC, 105 SC, 106 SC; 427/118, 120, 393.5, 388.2; 526/331; 264/174; 428/375, 379, 368, 372, 383

[56] References Cited

U.S. PATENT DOCUMENTS 2,852,487 9/1958 Maker ..... 528/36
4,226,823 10/1980 Jansson et al. ..... 174/120 SC

FOREIGN PATENT DOCUMENTS 48-27111 8/1973 Japan ..... 174/120 SC
959356 6/1964 United Kingdom .

*Primary Examiner*—Norman Morgenstern
*Assistant Examiner*—Richard Bueker
*Attorney, Agent, or Firm*—Sughrue, Mion, Zinn, Macpeak and Seas

[57] ABSTRACT

A process for producing a crosslinked polyethylene insulated cable having an outer semiconductive layer which comprises providing an internal semiconductive layer, and an electrically insulating layer on an electrical conductor in conventional manner, coating by extrusion a resin composition comprising 100 parts by weight of an ethylene/vinyl acetate copolymer having a vinyl acetate content of at least about 55% by weight and about 5 to about 100 parts by weight of carbon black and a crosslinking effective amount of a crosslinking agent on said electrically insulating layer and heating said coated composition to at least about 230° C. to crosslink said resin composition is disclosed. This process assures high production speed.

When the ethylene/vinyl acetate copolymer used has a vinyl acetate content of at least about 80% by weight the outer semiconductive layer can easily be peeled off by hand.

8 Claims, No Drawings

PROCESS FOR PRODUCING CROSSLINKED POLYETHYLENE INSULATED CABLE

This is a Continuation of application Ser. No. 99,810, filed Dec. 3, 1979, now abandoned.

BACKGROUND OF THE INVENTION

1. Field of the Invention

This invention relates to a process for producing a crosslinked polyethylene insulated cable, particularly a high voltage cable having an easily removable outer semiconductive layer.

2. Description of the Prior Art

A high voltage cable comprises an electrical conductor and formed thereon an internal semiconductive layer, an electrically insulating layer and an outer semiconductive layer. The last layer serves to alleviate or shield the surroundings from an electric field generated by the electrical conductor.

According to conventional techniques, this outer semiconductive layer is formed by winding an electrically conductive tape around the cable or by extrusion-coating thereon a composition obtained by mixing polyethylene, an ethylene/ethyl acrylate copolymer or an ethylene/vinyl acetate copolymer with electrically conductive carbon black and other additives such as talc, clay, calcium carbonate, magnesium oxide, zinc oxide, magnesium zinc salts, anti-oxidants or crosslinking agents. The use of tapes has the defect that the poor adhesion between the tapes and an insulator adversely affects the electrical properties of the cable. On the other hand, in processing the ends of a cable to form a junction, for instance, it is necessary to remove the outer semiconductive layer to a predetermined length and an extrusion-coated layer of the semiconductive composition cannot be as easily removed as the tape. The extrusion-coated outer semiconductive layer must therefore be shaved off. However, much time and care are required to remove the outer semiconductive layer without damaging the surface of the insulator.

Outer semiconductive layers which adhere well to the insulator but can be easily removed at the time of working the cable ends have been developed (for example, as disclosed in U.S. Pat. Nos. 3,719,769 and 3,684,821). Such outer semiconductive layers are made by kneading conductive carbon black with an ethylene/vinyl acetate copolymer (EVA for short), a copolymer of EVA and vinyl chloride (EVA-PVC for short), or a mixture of EVA and EVA-PVC, and can be easily peeled off upon working the cable ends without damaging the surface of the insulators. Moreover, these semiconductive layers do not separate from the insulators when the cables are used. These conductive layers have sufficient peelability and processability for practical purposes, however, even with these outer semiconductive layers sometimes the semiconductive layer cannot be completely removed and areas remain on the insulator after removal. In such a case, the remaining conductive layer must be removed by shaving or by wiping it off with a solvent. Furthermore, peroxide is added to these semiconductive layer compositions to effect crosslinking thereof such that the semiconductive layer has sufficient strength as an outer semiconductive layer (ordinarily about 0.5 to about 5 phr). Under some extrusion-processing conditions, small protrusions, termed "scorch" form on the surface of the outer semiconductive layer or between the outer semiconductive layer and the insulator at the time of producing the cables. When extruding compositions containing carbon, the temperature of the material increases due to heat generation by shearing and when a crosslinking agent is present in the composition crosslinking is often initiated by the heat thus generated which causes scorch and because of this it is very difficult to select conditions for extrusion when a composition contains carbon and a crosslinking agent.

On the other hand, in the conventional techniques in which polyethylene used for producing crosslinked polyethylene insulated cables, the cables are heated in most cases to about 200° C. to effect crosslinking. It is apparent that higher crosslinking temperature is desirable since it leads to a higher crosslinking speed and this in turn yields greater economical advantages. However, it has been difficult to further increase crosslinking speed when using conventional resin compositions since the resulting outer semiconductive layer cannot be peeled off with ease when the resin composition is heated to 230° C. or more although it is still peelable when the resin composition is heated at 200° C. The reason this phenomenon is observed is not completely clear at present but it is believed that it is ascribable to a relative decrease in the tensile strength of the outer semiconductive layer due to thermal deterioration of the resin material used therein with respect to peel strength of the outer semiconductive layer.

Thus, there has been increasing demand for crosslinked polyethylene insulated cables the outer semiconductor of which can be peeled off by hand without using special tools.

SUMMARY OF THE INVENTION

A primary object of the present invention is, therefore, to overcome the above defects and to provide a process for producing crosslinked polyethylene insulated cables having an outer semiconductive layer which can be easily produced with high production speed by extrusion coating and which can easily be removed with little contamination.

Another object of the present invention is to provide a process for producing crosslinked polyethylene insulated cables the outer semiconductive layer of which can be removed easily without using any special tool in processing them.

Further object of the present invention is to provide a process for producing a crosslinked polyethylene insulated cable having an outer semiconductive layer which gives rise to substantially no scorch when processing for a long period of time and which has satisfactory extrudability.

Thus, the present invention provides a process for producing a crosslinked polyethylene insulated cable having an outer semiconductive layer which comprises providing an internal semiconductive layer, and an electrically insulating layer on an electrical conductor in the conventional manner, extrusion coating a resin composition comprising 100 parts by weight of an ethylene/vinyl acetate copolymer having a vinyl acetate content of at least about 55% by weight or polyvinyl acetate and about 5 to about 100 parts by weight of carbon black and crosslinking the resin composition with an effective amount of a crosslinking agent on said electrically insulating layer by heating the coated composition to at least about 230° C.

A preferred embodiment the present invention provides a process for producing a crosslinked polyethylene insulated cable having an outer semiconductive layer which comprises providing an internal semiconductive layer and an electrically insulating layer on an electrical conductor in conventional manner, extrusion coating a resin composition comprising 100 parts by weight of an ethylene/vinyl acetate copolymer having a vinyl acetate content of at least about 80% by weight or polyvinyl acetate and about 5 to 100 parts by weight of carbon black and crosslinking the resin composition with an effective amount of a crosslinking agent on the electrically insulating layer by heating the coated composition to at least about 230° C.

DETAILED DESCRIPTION OF THE INVENTION

High voltage cables which can be used in this invention are preferably produced according to specifications for Crosslinked Polyethylene Insulated Shielded Power Cable Rated 5 to 69 KV, published by Association of Edison Illuminating Companies (AEIC) and those rated above 69 KV.

The term "semiconductive" as employed in this invention means preferably a volume inherent resistance of about $1\times10^1$ to about $9\times10^4$ ohm.cm.

Conductive carbon blacks conventionally used can be used in the present invention, e.g., acetylene black, furnace black, kitchen black, etc. Although the amount of the carbon black varies depending upon the type thereof, amounts providing sufficient conductivity for the layer to serve as a semiconductive layer are used. Generally, about 5 to about 100 parts by weight of carbon black is employed in the present invention per 100 parts ethylene/vinyl acetate copolymer or polyvinyl acetate.

Any conventionally used crosslinking agents can be used to crosslink the ethylene/vinyl acetate or polyvinyl acetate composition. For example dicumyl peroxide, di-(tert-butyl)peroxide, 2,5-dimethyl-2,5-di(tert-butyl)peroxyhexane, preferably 2,5-dimethyl-2,5-di(-tert-butyl)peroxyhexane, can be used generally in an amount of about 0.3 to about 2% by weight based on the weight of the resin.

As will be apparent to those skilled in the art, the resin compositions used to form the outer semiconductive layer can contain, if desired, anti-oxidants such as 4,4-thiobis(6-tert-butyl-m-cresol), stabilizers, plasticizers such as dioctyl phthalate, etc. fillers, anti-adhesive agents such as low molecular weight polyethylene, and the like generally in an amount of about 0.1 to about 0.5% by weight based on the weight of the resin, depending upon the characteristics desired.

The melt index of the resin composition is generally about 20 to about 100, preferably 25 to 30.

In the present invention crosslinking can also be effected at high temperatures, e.g., up to 290° C.

In the present invention tensile strength of materials were measured using samples of 0.8 mm in thickness and thus peel strength (kg/12.7 mm) is converted into $1/(12.7\times0.8)$ kg/mm$^2$.

Peel strength of the resin composition used in the present invention depends generally on the vinyl acetate content thereof and tensile strength thereof is dependent on the amount of a crosslinking agent.

The relationship between the vinyl content of the resin composition and its peel strength is as follows.

| | Vinyl Acetate Content (% by weight) | | | |
|---|---|---|---|---|
| | 40 | 60 | 80 | 90 |
| Peel Strength (kg/12.7 mm) | 3–5 | 1.5–3 | 0.5–1.5 | 0.3–1 |

The present invention will be explained hereinafter in greater detail with reference to the following Reference Examples, Examples and Comparison Example.

REFERENCE EXAMPLE 1

The peel strength (kg/12.7 mm) of some examples of the outer semiconductor layers having various compositions shown in Table 1 below were tested according to AEIC No. 6-75 (2nd Edition) H.1.

More particularly, each semiconductive material having the composition shown in Table 1 was premolded to form a sheet of a thickness of 1 mm and a polyethylene containing a crosslinking agent was also premolded to form a sheet of a thickness of 6 mm both by pressing at 120° C. for 10 minutes. Each of the thus obtained semiconductive sheet and polyethylene sheet were laminated and pressed at a crosslinking temperature of 200° C. for 20 minutes or at 250° C. for 20 minutes to form a crosslinked laminate sample. Cuts with a width of 12.7 mm were provided on the semiconductive sheet of the resulting sample, and the peel strength of each sample was determined using an Instron type universal tester at a drawing speed of 200 mm/min. The results obtained are shown in Table 2.

TABLE 1

| Composition. | Sample 1 (Invention) | Sample 2 (Invention) | Sample 3 (Comparison) | Sample 4 (Comparison) |
|---|---|---|---|---|
| Evathlene 431P(1) | 100 | — | — | — |
| Evathlene 450P(2) | — | 100 | — | — |
| EVA M 5011(3) | — | — | 100 | — |
| Elaslene 401(4) | — | — | — | 100 |
| DOP(5) | — | — | — | 30 |
| Denkablack(6) | 55 | 55 | 55 | 55 |
| DCP(7) | 1.5 | 1.5 | 1.5 | 1.5 |
| SWC(8) | 0.3 | 0.3 | 0.3 | 0.3 |
| $CaCO_3$ | 7.5 | 7.5 | 7.5 | 7.5 |
| TLB(9) | | | | 3 |

(1)Evathlene 431P Ethylene/vinyl acetate copolymer having a vinyl acetate content of 55%. A product of Dai Nippon Ink Manufacturing Co., Ltd.
(2)Evathlene 450P Ethylene/vinyl acetate copolymer having a vinyl acetate content of 60%. A product of Dai Nippon Ink Manufacturing Co., Ltd.
(3)EVA M 5011 Ethylene/vinyl acetate copolymer having a vinyl acetate content of 35% and a Melt Index of 60%. A product of Sumitomo Chemical Co., Ltd.
(4)Elaslene 401A Chlorinated polyethylene. A product of Showa Denko Co., Ltd.
(5)DOP Dioctyl phthalate
(6)Denkablack Carbon black. A product of Denki Kagaku Co., Ltd.
(7)DCP Dicumyl peroxide
(8)SWC Santo White Crystal. A product of Kawaguchi Kagaku Co., Ltd.
(9)TLB Tribasic lead sulfate

TABLE 2

| Crosslinking Condition | Peel Strength (kg/12.7 mm) Sample 1 (Invention) | Sample 2 (Invention) | Sample 3 (Comparison) | Sample 4 (Comparison) |
|---|---|---|---|---|
| 200° C., 20 min. | 2.0 | 1.5 | 4–7 | 1.5 |
| 250° C., 20 min. | 1.5 | 1.5 | Broken | Broken |

As will be clear from the results shown in Table 2 above semiconductive resin materials containing ethylene/vinyl acetate copolymer having a vinyl content of 55% or more as a major component such as Sample 1 and 2 were able to be peeled off even when heated to high temperatures. On the other hand, those containing ethylene/vinyl acetate copolymer having a vinyl content of less than 55% such as Sample 3 or chlorinated polyethylene such as Sample 4 as a major component were difficult to peel because the breakage of the material occurs when crosslinking was effected at high temperatures.

Further investigations have been made to provide a process for producing a crosslinked polyethylene insulated cable which permits easy removal of the outer semiconductive layer thereof at the time of processing or working by hand without using any special tool and which can be produced with satisfactory speed. As a result of these investigations it has been found that the process for producing crosslinked polyethylene insulated cable according to the present invention in which the vinyl acetate content of ethylene/vinyl acetate copolymer used in the outer semiconductive layer thereof is at least about 55% by weight of polyvinyl acetate is generally suited for the production of crosslinked polyethylene insulated cable comprising an outer semiconductive layer having a peel strength of about 3.5 kg/12.7 mm. and that peeling can be performed by hand without using any special tool when the outer semiconductive layer has a peel strength of at most 1.5 kg/12.7 mm.

Further it has been found that the difference between the peel strength and tensile strength of the material for the outer semiconductive layer is 0.6 kg/mm$^2$ or more processability of the outer semiconductive layer is satisfactory. These are demonstrated in Reference Example 2 below.

REFERENCE EXAMPLE 2

Peelability and processability of some examples of semiconductive layers having different vinyl acetate contents were tested.

Laminate samples of semiconductive sheets having the composition shown in Table 3 below and a polyethylene sheet containing a crosslinking agent were produced in the same manner as in Reference Example 1 except that crosslinking was carried out at 250° C. for 20 minutes and the peel strength of the samples thus obtained was tested in the same manner as in Reference Example 1. To evaluate the extrudability of the samples, the torque at 160° C. as well as the time from the appearance of an initial torque peak to that of a torque peak indicating the occurrence of scorch were measured using a Brabender Plastograph. The results obtained are shown in Table 4.

TABLE 3

| Resin Composition | Sample 5 (Comparison) | Sample 6 (Invention) | Sample 7 (Invention) | Sample 8 (Invention) |
|---|---|---|---|---|
| Evatate R 5011(1) | 100 | — | — | — |
| Evathlene 450P(2) | — | 100 | — | — |
| Evathlene 250(3) | — | — | 100 | — |
| Evathlene 150P(4) | — | — | — | 100 |
| Denkablack(5) | 60 | 60 | 60 | 60 |
| YPO(6) | 1 | 1 | 1 | 1 |

TABLE 3-continued

| Resin Composition | Sample 5 (Comparison) | Sample 6 (Invention) | Sample 7 (Invention) | Sample 8 (Invention) |
|---|---|---|---|---|
| SWC(7) | 0.5 | 0.5 | 0.5 | 0.5 |

(1)Evatate R5011 Ethylene/vinyl acetate copolymer having a vinyl acetate content of 45% by weight. A product of Sumitomo Chemical Co., Ltd.
(2)Evathlene 450P Ethylene/vinyl acetate copolymer having a vinyl acetate content of 60% by weight. A product of Dai Nippon Ink Manufacturing Co., Ltd.
(3)Evathlene 250P Ethylene/vinyl acetate copolymer having a vinyl acetate content of 80% by weight. A product of Dai Nippon Ink Manufacturing Co., Ltd.
(4)Evathlene 150P Ethylene/vinyl acetate copolymer having a vinyl acetate content of 90% by weight. A product of Dai Nippon Ink Manufacturing Co., Ltd.
(5)Denkablack Carbon black. A product of Denki Kagaku Co., Ltd.
(6)YPO 2,5-dimethyl-2,5-di(tert-butyl)hexyne-3
(7)SWC Santo White Crystal. A product of Kawaguchi Kagaku Co., Ltd.

TABLE 4

| | Sample 5 | Sample 6 | Sample 7 | Sample 8 |
|---|---|---|---|---|
| Peelability (kg/12.7 mm) | 3.5–5 | 1.5–3 | 0.5–1.5 | 0.5–1.5 |
| Difference between Peel Strength and Tensile Strength of the Material (kg/mm$^2$) | 0.4 | 0.3 | 0.6 | 0.9 |
| Extrudability | | | | |
| Torque at 160° C. (kg-m) | 1,900 | 1,900 | 1,500 | 1,500 |
| Time elapsed before scorch occurs (minutes) | 15 | 15 | 27 | 27 |

From the results shown in Table 4 above it can be seen that only those semiconductive materials which contain ethylene/vinyl acetate copolymer having a vinyl acetate content of at least about 80% by weight can provide crosslinked polyethylene insulated cables which satisfy conditions under which peeling of the outer semiconductive layer can be performed by hand without using any special tool, i.e., a peel strength of 1.5 kg/12.7 mm or less in accordance with the preferred embodiment of the present invention.

It can also be seen from the above results that with increasing vinyl acetate content difference between peel strength and tensile strength of the resin composition, torque and time which elapsed before scorch occurs increase and when the vinyl acetate content of the resin composition is 80% by weight or more practically satisfactory processability is obtained.

The present invention is based on the above finding and preferred embodiments thereof are described below.

EXAMPLE 1

On a stranded copper conductor having a cross-section of 150 mm$^2$ was extrusion coated a conventional internal semiconductive layer. Then a polyethylene insulating layer containing a crosslinking agent and an outer semiconductive layer having the same composition as Sample 1 in Reference Example 1 were extrusion-coated on the internal semiconductive layer simultaneously. The cable thus produced was heated at 270° C. for 20 minutes in a nitrogen atmosphere at a pressure of 10 kg/mm$^2$ to produce a crosslinked polyethylene insulated cable rated 22 KV. In this case crosslinking speed was 1.5 times as fast as that observed when heating was at 200° C. Cuts with a width of 12.7 mm were provided on the outer semiconductive layer of the resulting cable and a peeling test was conducted. The peel strength measured was 3.5 kg/12.7 mm.

EXAMPLE 2

A crosslinked polyethylene insulated cable rated 22 KV was produced in the same manner as in Example 1 except that heating for crosslinking was conducted at 230° C. for 30 minutes instead of heating at 270° C. for 20 minutes. In this case crosslinking speed was 1.3 times as fast as that observed when heating was at 200° C. The same tests as in Example 1 revealed that the peel strength of the cable was 3.5 kg/12.7 mm.

COMPARISON EXAMPLE

A crosslinked polyethylene insulated cable was prepared in the same manner as in Example 1 except that the outer semiconductive layer was that of Sample 4 instead of Sample 1 of Reference Example 1. Peelability test of the outer semiconductive layer of the cable which was conducted in the same manner as in Example 1 revealed that cuts of a width of 12.7 mm caused breakage of the outer semiconductive layer.

EXAMPLE 3

On a stranded copper conductor having a cross-section of 150 $mm^2$ was extrusion-coated a conventional internal semiconductive layer, and a polyethylene insulation containing a crosslinking agent and an outer semiconductive layer having the same composition as Sample 7 of Reference Example 2 in this order simultaneously. The resulting cable was heated at 270° C. for 20 minutes in a nitrogen atmosphere at a pressue of 10 $kg/mm^2$ to produce a crosslinked polyethylene insulated cable rated 22 KV. Crosslinking speed in this example was 1.5 times as fast as that observed when heating was at 200° C. Cuts with a width of 12.7 mm were provided on the outer semiconductive layer of the resulting cable and peeling test was conducted. The peel strength was 1.3 kg/12.7 mm and the outer semiconductive layer was removed easily by hand without using any special tool.

EXAMPLE 4

A crosslinked polyethylene insulated cable rated 22 KV was produced in the same manner as in Example 3 except that heating for crosslinking was conducted at 230° C. for 30 minutes instead of heating at 270° C. for 20 minutes. Crosslinking speed in this case was 1.3 times as fast as that observed when heating was at 200° C. The same tests as in Example 1 revealed that the peel strength of the cable was 1.3 kg/12.7 mm and the outer semiconductive layer could be easily removed by hand without using any special tool.

While the invention has been described in detail and with reference to specific embodiments thereof, it will be apparent to one skilled in the art that various changes and modifications can be made therein without departing from the spirit and scope thereof.

What is claimed is:

1. A process for producing a crosslinked polyethylene insulated cable having an outer semiconductive layer which comprises providing an internal semiconductive layer, and an electrically insulating layer on an electrical conductor in conventional manner, coating by extrusion a resin composition comprising 100 parts by weight of an ethylene/vinyl acetate copolymer having a vinyl acetate content of at least about 55% by weight and about 5 to about 100 parts by weight of carbon black and a crosslinking effective amount of a crosslinking agent on said electrically insulating layer and heating said coated composition to at least about 250° C. in a nitrogen atmosphere to crosslink said resin composition.

2. The process of claim 1, wherein said ethylene/vinyl acetate copolymer has a vinyl content of at least about 80% by weight.

3. A crosslinked polyethylene insulated cable produced by the process of claim 1.

4. A crosslinked polyethylene insulated cable produced by the process of claim 2.

5. The process of claim 1, wherein from about 0.3 to about 2 wt% of said crosslinking agent is present, based on the weight of the resin.

6. The process of claim 1, wherein said crosslinking is conducted at a temperature up to 290° C.

7. The process of claim 1, wherein said temperature is at least 270° C.

8. The process of claim 7, wherein said temperature is up to 290° C.

* * * * *